United States Patent [19]

King

[11] 3,985,564

[45] Oct. 12, 1976

[54] PHOTOGRAPHIC ELEMENT AND PROCESS FOR DEVELOPING

[75] Inventor: James R. King, Webster, N.Y.

[73] Assignee: Eastman Kodak Company, Rochester, N.Y.

[22] Filed: Jan. 30, 1973

[21] Appl. No.: 327,885

[52] U.S. Cl. ..... 96/95; 96/113

[51] Int. Cl.[2] ..... E03C 1/06

[58] Field of Search ..... 96/95, 61, 66, 113

[56] References Cited

UNITED STATES PATENTS

| | | | |
|---|---|---|---|
| 2,110,491 | 3/1938 | Salo | 96/61 R |
| 3,220,839 | 11/1965 | Herz et al. | 96/61 R |
| 3,506,444 | 4/1970 | Haist et al. | 96/61 R |
| 3,531,285 | 9/1970 | Haist et al. | 96/61 R |
| 3,669,670 | 6/1972 | Haist et al. | 96/95 |
| 3,816,136 | 6/1974 | Goffe et al. | 96/67 |

OTHER PUBLICATIONS

Mason, Photographic Processing Chemistry, 1966 pp. 15–28.

*Primary Examiner*—Mary F. Kelley

*Attorney, Agent, or Firm*—Henry E. Byers

[57] ABSTRACT

A radiation-sensitive element in which silver halide is the sole source of image-forming silver containing incorporated processing chemicals is processed in a fluid activator which does not cause the processed element to be tacky. The element includes a fluid-impermeable support having thereon a radiation-sensitive material in a hydrophobic binder which is impermeable to water. Activation of the exposed radiation-sensitive material by the fluid activating agent results in a processed element which is dry to the touch and is substantially free from tackiness when removed from contact with the fluid activator. If a stabilizer precursor is incorporated in the element, the image is unaffected by further exposure to radiation.

24 Claims, 1 Drawing Figure

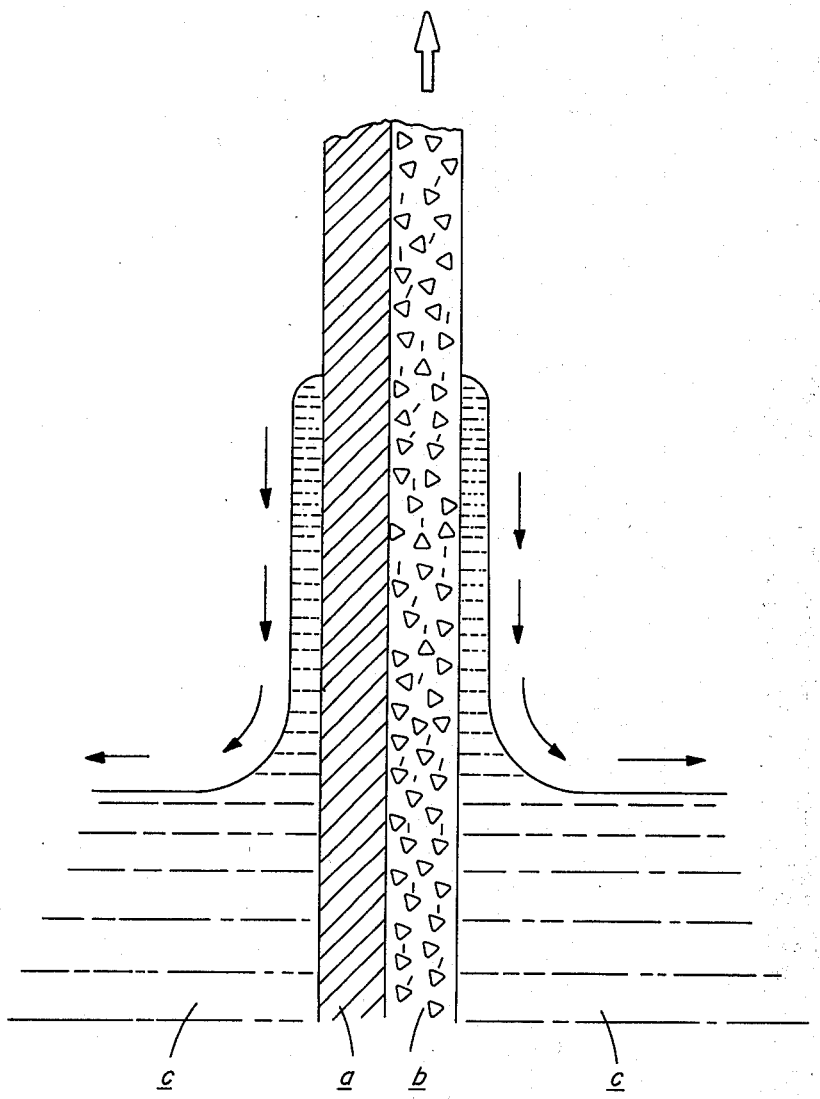
c
a
b
c

PHOTOGRAPHIC ELEMENT AND PROCESS FOR DEVELOPING

BACKGROUND OF THE INVENTION

This invention relates to a method of processing radiation-sensitive elements in which silver halide is the sole source of image-forming silver containing incorporated processing chemicals by contacting the element with a fluid activator which permits the element to emerge from the activator substantially dry to the touch and free from tackiness when contacted against a similar surface. It also relates to photographic elements which comprise a water-impermeable support having thereon a radiation-sensitive material; such as, silver halide in a water-impermeable hydrophobic binder, a developing agent and, preferably, a stabilizer precursor which may be dispersed in the hydrophobic binder. The element is permeable to ammonia or amine vapor or to an amine contained in an aqueous solution or other solvent that leaves the surface substantially dry and tack free after immersion of the element therein.

Photographic elements have conventionally been processed using liquid solutions which have contained processing chemicals or by immersing an element in a liquid activator solution. In particular, silver halide emulsions dispersed in gelatin or a similar hydrophilic vehicle, have absorbed water resulting in a swelling of the binding material and generally tacky or sticky surfaces. This has inhibited handling of the wet elements, has required an extensive drying treatment, for example, with hot air, and has presented storage problems, and the like. In order to avoid these types of problems, many so-called dry processes have been proposed, including those which require heat to initiate or provide the activation necessary to process an exposed element. For instance, Jacobs, U.S. Pat. No. 3,248,219, issued Apr. 26, 1966, discloses a photographic element for dry processing which comprises a support, a silver halide emulsion, and on the same support, a dry developing agent which requires the presence of water to become active, and, in a separate layer, a stabilizing agent which is activated by the presence of water, having over the element as an overcoat, a sealer layer which may comprise vegetable gum, gum tragacanth, gum arabic, etc. Such overcoats, however, are tacky after immersion in an aqueous amine solution or on contact with ammonia or amine vapor long enough to develop an image in the exposed element. Further, such an element containing the stabilizing agent in a reactive form may cause stabilization prior to exposure and activation.

Gaspar, U.S. Pat. No. 2,361,936, issued Nov. 7, 1944, discloses a liquid processable photographic element comprising a support having thereon a silver halide emulsion layer having a water-insoluble binder; such as, a cellulose ester or synthetic polymer. However, a second component is required which is at least capable of swelling in water so that the binder is not water-impermeable.

Hilborn, U.S. Pat. No. 2,748,022, issued May 29, 1956, discloses cellulose ester carriers for silver halide which contain ammonium carbonate or bicarbonate to render them susceptible to penetration by water or aqueous liquids. An amount of 2 to 10 times the amount of the ester is required.

In certain specialized types of photography, it is desirable to have the element exposed and developed without moving the element after exposure. This is particularly important when used in preparing holographs. A process for processing in place using ammonia or amine vapor for processing a radiation-sensitive element which contains incorporated processing chemicals; such as, a developing agent and stabilizer precursor has been described in King, U.S. patent application Ser. No. 224,935, filed Feb. 2, 1972 now abandoned. However, in the case of silver halide materials, this element is tacky to the touch so that it is not conveniently handled or stored immediately following processing. Accordingly, there has been a need for a similar product which could be processed in place which would be substantially dry to the touch and free from tackiness after being processed.

SUMMARY OF THE INVENTION

An image is obtained in an exposed radiation-sensitive silver halide element in which silver halide is the sole source of image-forming silver by a process which involves contacting the element with a fluid activator such as a vapor or liquid activator. The element comprises a support which is substantially impermeable or uneffected by the fluid activator and has thereon a radiation-sensitive silver halide material in a water-impermeable binder and a developing agent for the material in the same or different layer, which is activated by the fluid activator. The processed image side of the element after being removed from contact with the fluid, either by discontinuing the vapor contact or by removing from a solution, is substantially free from tackiness and appears dry to the touch.

A particularly useful process comprises developing an element in which silver halide is the sole source of image-forming silver comprising a substantially water-impervious support, having thereon a radiation-sensitive layer such as a silver halide emulsion, and a developing agent for the silver halide salt in the same or different layer. The binder is substantially impervious to water but is pervious to an alkaline fluid activator; such as, for example, ammonia, amine vapors, or to an amine from an aqueous amine solution. The exposed element is processed by contacting with ammonia or an amine vapor or by immersing in an aqueous solution containing an amine. After processing, the surface of the element is substantially dry to the touch and is relatively free from tackiness when contacted against itself. In a preferred embodiment, a stabilizer precursor is also incorporated in the element so that the processed element is stable to exposure to radiation.

In one embodiment, a polyester support has thereon a silver halide emulsion, a developing agent and a stabilizer precursor incorporated in a cellulose propionate vehicle. The element is immersed in an aqueous solution containing about 50 percent by weight ethanolamine and results in a stabilized element containing a silver image in less than a minute at 60° C.

BRIEF DESCRIPTION OF THE DRAWING

In the accompanying drawing:

FIG. 1 illustrates one embodiment of our invention wherein a support *a*, such as poly(ethylene terephthalate), is coated with a layer *b* comprising silver halide emulsion, developing agent and a stabilizer precursor in a binder of cellulose propionate. After exposing to a light image, the exposed element is immersed in an activator bath *c* comprising an aqueous-ethanolamine solution (50-50 by weight). The activating amine penetrates the barrier layer to cause the developing agent to reduce the exposed silver halide, creating a visible image, and the stabilizer precursor to stabilize the element against further development of density on further exposure to light.

As the element is withdrawn from the activator bath *c* the solution drains from the surface of the element. The surface of the silver halide layer *b* appears dry to the touch and is free from tackiness as described hereinbelow.

DESCRIPTION OF THE PREFERRED EMBODIMENTS

Vapor processing, such as can be performed according to this invention, is ideally suited for single exposure holographic interferometry. See "Principles of Holography" by Howard H. Smith, 1969, John Wiley, N.Y., N.Y. With this method of interferometry it is necessary that the exposed emulsion be in precisely the same position during exposure to the object beam and reference beam and for read-out using the reference beams. The hologram must be struck by the read-out beam in order to see the image at precisely the same angle as during exposure. If the film has to be moved for processing, it is difficult to design a system for registering the film. If the film is processed conventionally, but in place, the arrangements for admitting and flushing the various liquid chemicals is complex, costly and slow. Also, with wet processing, the dimensional stability of the emulsion is not good, which is detrimental to single exposure holographic interferometry. Vapor processing is dry, fast and economical and can be performed easily with the emulsion in-place; negligible swelling of the emulsion occurring. Moreover, there is wide latitude in temperature and time; vapor processing can be carried out at temperatures of from about 15°C to about 66°C to obtain useful images within from about 1 to 180 seconds.

By using the element of our invention, the exposed and processed element is dry to the touch and can be rolled upon itself immediately without stickiness or tackiness, which normally occurs when a gelatin emulsion without an overcoat is vapor processed.

Various photographic salts, especially photographic silver salts can be employed in the elements used in the invention. These include photographic silver halide, such as silver iodide, silver bromide, silver chloride, as well as mixed halides, such as silver bromoiodide, silver chloroiodide, and the like. Radiation-sensitive silver halides are typically coated in an amount of 1.5 mg. of silver to 50 mg. of silver per square decimeter and preferably about 12 mg. per decimeter.

Developing agents can be incorporated in the photographic element in one or more layers using well-known techniques in the photographic art. For example, they can be dissolved in a suitable solvent and added or they can be added in the form of a dispersion. Techniques of this type are described, for example, in U.S. Pat. No. 2,322,027 of Jelley et al. issued June 15, 1943 and U.S. Pat. No. 2,801,171 of Fierke et al issued July 30, 1957. In a preferred embodiment, methyl gallate/1-phenyl-3-pyrazolidone (10/1) developer is used.

Suitable silver halide developing agents which can be employed in the practice of the invention include, for example, polyhydroxy benzenes, such as hydroquinone developing agents, e.g. hydroquinone, alkyl substituted hydroquinone such as tertiary butyl hydroquinone, methyl hydroquinone, carboxyalkyl hydroquinones and 2,5-dimethylhydroquinone; catechol and pyrogallol; chloro substituted hydroquinones such as chlorohydroquinone or dichlorohydroquinone; alkoxy substituted hydroquinones such as methoxyhydroquinone or ethoxyhydroquinone; aminophenol developing agents such as 2,4-diaminophenols, e.g., 2,4-diamino-6-methylphenol, and methylaminophenols; hydroxyl amines, such as N,N-di(2-ethoxyethyl)-amine; 3-pyrazolidone developing agents, such as 1-phenyl-3-pyrazolidone, including those described in British Patent No. 930,572; ascorbic acids, such as d-araboascorbic acid, iminogluco ascorbic acid, isopropylidene ascorbic acid; hydroxytetronic acids, such as phenylhydroxytetronic acid, phenylhydroxy tetronimide; pyrimidine developing agents such described by Henn and Carpenter, "Photographic Science and Engineering", Vol. 3, pages 135–139, 1959; reductones as amino hexose reductones disclosed in French Patent No. 2,065,792; and acyl derivatives of aminophenols, such as described in British Patent No. 1,045,303. These developing agents can be used alone or in combination.

Particularly useful developing agents include methyl gallate, hydroquinone, gallic acid, (2,5-dihydroxyphenyl) acetic acid, 2,5-dihydroxy-p-benzenediacetic acid, 2′,3′,4′-trihydroxyacetophenone, 2-isopropyl-4,5,6 trihydroxypyrimidine, 3,6-dihydroxybenzonorbornane, pyrogallol, ascorbic acid, 1-phenyl-3-pyrazolidone and phenyl hydroquinone.

The developing agents can be employed in a wide range of concentrations. Normally, concentrations of about 0.25 to about 4.0 moles per mole of silver of the principal developing agent can be employed. Lesser amounts, such as 0.05 to 0.5 moles of auxiliary developing agents are useful. One mole of developing agent per mole of silver present in the photographic element is often suitable.

The photosensitive elements used in the practice of the invention embodying the hydrophobic binder can contain various hydrophobic materials alone or in combination as vehicles or binding agents. Suitable materials are typically hydrophobic colloids which are transparent or translucent and include cellulose esters such as, for example, cellulose esters formed from lower organic acids such as, for example, cellulose acetate, cellulose acetate propionate, cellulose propionate, cellulose butyrate, cellulose acetate butyrate, etc. Cellulose nitrate can be used as well as layers of other polymers which are impermeable to water and permeable to ammonia or amines.

The stabilizer precursors which may be used in this invention include the compounds of Humphlett et al, U.S. Pat. No. 3,301,678 issued Jan. 31, 1967. These compounds can be represented by the following formulas:

Formula I

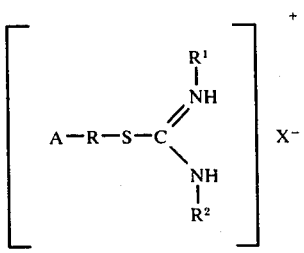

+

Formula II

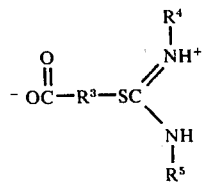

-continued

| Formula III | Formula IV |
|---|---|
| 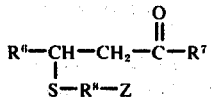 | 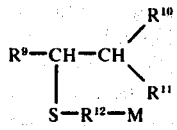 |

In the above formulas: R, $R^3$, $R^8$ and $R^{12}$ are each lower alkylene radicals having 1 to 5 carbon atoms including methylene, ethylene, propylene, butylene, isobutylene, and amylene, $R^1$, $R^2$, $R^4$, $R^5$ and $R^9$ are each hydrogen atoms, lower alkyl radicals having 1 to 5 carbon atoms or aryl radicals having 6 to 12 carbon atoms such as phenyl and naphthyl and amino radicals such as morpholino, piperidino, pyrrolidino, and dialkyl amino wherein the alkyl moiety has 1 to 5 carbon atoms. Compounds of Formula III and Formula IV above are commonly prepared as salts such as hydrochloride salts to facilitate purifications and to increase their water solubility to facilitate incorporation in photographic layers. Suitable compounds within the scope of these generic structures include:

2 -hydroxyethylisothiuronium chloride
2-hydroxyethylisothiuronium trichloroacetate isothiureidoacetic acid
2-isothiureidopropionic acid
β-(2-morpholinoethylthio)-β-phenylpropiophenone hydrochloride
2-ethylaminoethylisothiuronium chloride
2-hydroxypropylisothiuronium trichloroacetate
α-Nitrilo-β-(2-morpholinoethylthio)propionitrile hydrochloride
α-Carbethoxy-β-(2-morpholinoethylthio)-β-phenylpropionitrile hydrochloride
Ethyl α-amido-β-(2-morpholinoethylthio)-β-phenylpropionate hydrochloride
2-hydroxyethyl-1-methylisothiuronium chloride
2-hydroxyethyl-1-phenylisothiuronium chloride
1-phenyl-2-isothiureidoacetic acid.

Other suitable stabilizer precursors include those of U.S. Pat. No. 3,220,839—Herz and Kalenda. These include isothiourea derivatives represented by the general structures:

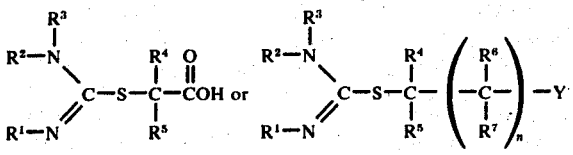

$R^1$, $R^2$, $R^3$, $R^4$, $R^5$, $R^6$ and $R^7$ can be hydrogen atoms, hydrocarbon radicals such as aryl radicals having 6 to 12 carbon atoms as illustrated by phenyl radicals, alkyl-substituted phenyl and alkyl radicals and substituted alkyl radicals. $R^1$ and $R^2$ can also be acyl radicals having the formula:

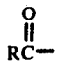

wheren R is an alkyl radical having 1 to 5 carbon atoms. $R^1$ and $R^2$ together can be the necessary atoms to form a heterocyclic ring or preferably they can be the necessary carbon and hydrogen atoms to form an alkylene radical linking both adjacent nitrogen atoms to form a cyclic nucleus as illustrated by the following moiety wherein $R^8$ is an alkylene radical having 2 to 20 carbon atoms, more generally 2 to 4 carbon atoms.

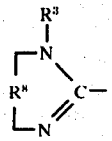

wherein $R^3$ can be an acyl radical having 2 to 6 carbon atoms in addition to those substituents described above for $R^3$. The letter *n* can be an integer of at least 1, and generally 1 to 10, and preferably 1 to 3. The letter Y can be a carboxyl radical, a sulfonate radical, a hydroxyl radical or an amino radical, including substituted amino radicals, of the formula

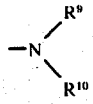

wherein $R^9$ is a hydrogen atom or an alkyl radical, and wherein $R^{10}$ is a hydrogen atom, an alkyl radical or an acyl radical, their salts having the formula

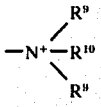

or a morpholino radical. Typical alkyl and alkylene radicals referred to above have 1 to 20 carbon atoms and more generally 1 to 4 carbon atoms. Illustrative alkyl radicals include methyl, ethyl, isopropyl, n-butyl, 2-ethylhexyl, n-decyl, stearyl, n-eicosyl and the like radicals. Alkylene radicals analogous to such alkyl radicals are suitable $R^8$ substituents. Suitable compounds within the scope of this structure include, for example, 2-S-thiuronium ethane sulfonate:

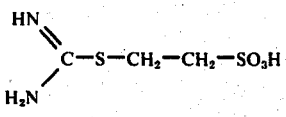

3-S-thiuronium propane sulfonate:

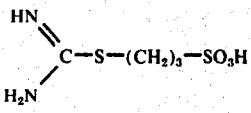

4-S-thiuronium butane sulfonate:

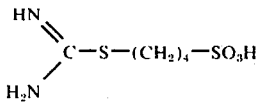

3-S-thiuronium-1-methyl-propane sulfonate:

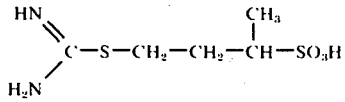

A useful class of S-carbamoyl silver salt stabilizer precursors includes compounds represented by the formula:

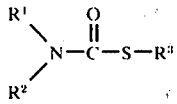

wherein $R^1$ and $R^2$ are each selected from the group consisting of hydrogen, alkyl, especially alkyl containing 1 to 5 carbon atoms such as methyl, ethyl, propyl, butyl and pentyl, aryl, e.g. phenyl and tolyl; and $S—R^3$ is a sulfur containing moiety which has the property of complexing with photosensitive silver halide in the presence of heat or alkali. The alkyl and aryl radicals and the sulfur containing moiety can contain substituent groups which do not adversely affect stabilizing action or desired properties of the described silver salt stabilizer precursor or the photosensitive material in which the precursors are employed. Typical examples of substituent groups which do not adversely affect the activity of the stabilizer precursor include methyl, ethyl, propyl, isopropyl, tertiary butyl and n-butyl. The described compounds also include salts of such compounds, such as amine salts, which do not adversely affect the activity of the stabilizer precursor. The described sulfur-containing moiety which has the property of complexing with photosensitive silver halide in the presence of heat and/or alkali, is a moiety which will cleave or be released from the described carbamoyl stabilizer precursor at elevated temperatures or in the presence of alkali such as ammonia or amine vapors and complexes or combines with a photosensitive silver salt such as photosensitive silver halide in unexposed areas of a photosensitive silver salt material, such as a photosensitive silver halide emulsion, forming a mercaptide compound which is more stable to light, atmospheric conditions and ambient temperatures than the photosensitive silver salt.

Especially useful S-carbamoyl silver salt stabilizer precursors include:

S-ethylcarbamoyl-2-mercaptoisobutyric acid, dicyclohexylamine salt,

S-ethylcarbamoyl-2-mercaptoethylamine, p-toluene sulfonic acid salt, 3-(Ethylcarbamoylthio)propanesulfonic acid, guanidinium salt, and S-ethylcarbamoyl-N-acetyl-2-mercaptoethylamine.

The described S-carbamoyl silver salt stabilizer precursors can be prepared by procedures known in the art. For instance, procedures described in St. Guttmann, Helv. Chem. Acta, 40:83 (1966) are suitable.

In one embodiment the above compounds which contain a sulfonate radical and form so-called inner acid salts are preferred stabilizer precursors. Inner acid salts as employed herein are disclosed in Herz and Kalenda U.S. Pat. No. 3,220,839 issued Nov. 30, 1965.

The stabilizer precursors employed in this invention are generally stable and substantially inert in photographic silver halide emulsions in acidic or neutral media and under temperatures that prevail during conventional storage and use of the photographic products.

The stabilizer precursor can be incorporated in photographic emulsions or layers of photographic elements using any of the techniques commonly used in the photographic art. For example it can be dissolved in a suitable solvent and added as such or it may be added in the form of a dispersion. Techniques which may be employed in adding the precursor to photographic elements can be similar to the techniques used for adding color couplers to photographic emulsions. Techniques of this type are disclosed, for example, in U.S. Pat. No. 2,320,227 and U.S. Pat. No. 2,801,171. Solvents or diluents which are miscible with components employed may be utilized to aid in the addition.

The stabilizer precursors are utilized in the elements used in this invention in concentrations of generally about 0.01 mole to about 10 moles per mole of silver salt and preferably from about 0.4 mole to about 2.0 mole per mole of silver halide.

The radiation-sensitive layers and other layers of an element employed in the practice of the invention and described herein can be coated on a wide variety of impervious supports. Typical supports include cellulose nitrate film, cellulose ester film, poly(vinylacetal) film, polystyrene film, poly(ethylene terephthalate) film, polycarbonate film and related films or resinous materials, as well as glass, metal and the like. Typically, a flexible support is employed; for instance, paper coated on both sides with polymeric material; such as, an alpha olefin polymer containing 2 to 10 carbon atoms; for example, polyethylene, polypropylene, polybutylene copolymers and the like.

In a preferred embodiment, a photographic element has on a support a silver halide emulsion, a silver halide developing agent and a stabilizer precursor, all in a polymeric binder. The polymeric material is substantially impervious to water but is permeable to ammonia, amine vapors and to liquid amines. These materials are known as elastomeric materials and are materials which can be dissolved in an organic liquid and which will give a continuous film when the solvent is evaporated. Elastomeric materials which can be suspended in water or an organic liquid and which will give a continuous film when the suspending medium is evaporated are also useful.

Preferably, the resulting element having the elastomer as a binder is dry to the touch and substantially free from tack after processing. Freedom from tack is determined by contacting with a similar surface as follows. Exposed 35 mm strips are contacted with an activator fluid to give an image having a density ($D_{max}$) of at least 0.5, withdrawn through squeegees if a liquid is employed and pressed into contact, emulsion side to emulsion side, with an unprocessed piece of the same film between rollers having a pressure of about 15 pounds total pressure on the rollers. After a contact time of 50 minutes, they are stripped apart using a spring gauge to measure the force needed for stripping.

In a preferred embodiment, the force is from 0 to about one-half ounce. When the overcoated element of the invention is used with ammonia or amine vapor processing, similar freedom from tackiness is obtained.

The elastomeric materials can be varied widely but include the following, for example:

1. Butadiene polymers: copolymers of butadiene with acrylonitrile, styrene and esters of acrylic acid.

2. Polyvinyl acetals: acetals of polyvinyl alcohol made with higher aldehydes; such as, butyraldehyde, 2-ethylhexaldehyde and heptaldehyde.

3. Vinyl polymers: homopolymers and copolymers; such as, those made from vinyl chloride, esters of acrylic acid, esters of methacrylic acid, and vinyl acetate.

4. Chloroprene: polymers and copolymers of chloroprene with acrylonitrile, styrene and esters of acrylic acid.

5. Diisocyanate-linked condensation elastomers: diisocyanates; such as, toluene diisocyanate reacted with relatively short linear polyester molecules to form polyurethanes and polymers produced from the reaction of diisocyanates with diamines; such as 3,3′(2,2-dimethyltrimethylenedioxy)bis propyl amine.

6. Cellulosic esters: cellulose esters; such as, cellulose acetate, cellulose acetate propionate, cellulose butyrate, cellulose propionate and cellulose acetate butyrate.

7. Cellulosic ethers: cellulose ethers; such as, ethyl cellulose and methyl cellulose.

8. Silicones: polysiloxanes having the following general formula:

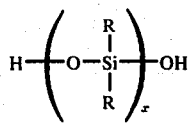

wherein $x$ is an integer from 6 to 40, and R is a methyl or a phenyl radical so chosen that both radicals on any given silicone atom are identical and the molar ratio of methyl to phenyl radicals varies from 4:1 to 1:4. Higher molecular weight siloxanes are operable for use in this invention; Organosilicone block polymers prepared by reacting a polypropylene oxide-polyethylene oxide block polymer with the following general structure:

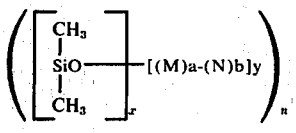

wherein $a$ and $b$ are positive integers, M is a polyethyleneoxy chain constituting approximately 10–70 percent by weight of $[(M)a-(N)b]y$, N is a polypropyleneoxy chain having a molecular weight between approximately 800 and 3000, and wherein $x$, $y$ and $n$ are positive integers as shown in Table A.

TABLE A

| COMPOUND | RATIO y:x | n | PERCENT silicon |
|---|---|---|---|
| A | 2:1 | 7 | 9.3 |
| B | 2:1 | 6 | 7.0 |
| C | 4:1 | 3 | 8.0 |
| D | 2:1 | 7 | 12.0 |
| E | 2:1 | 8 | 13.0 |

TABLE A-continued

| COMPOUND | RATIO y:x | n | PERCENT silicon |
|---|---|---|---|
| F | 1.5:1 | 1 to 8 | 6.3 |
| G | 1:1.5 | 2 | 1.4 |
| H | 1:1.5 | 1 | .62 |
| I | 1:1 | 1 | .2 |

When the film-forming elastomer is used as a suspension, water or an organic liquid may be used as the suspending medium. When the elastomer is used as a solution, an organic solvent may be used. Since this organic solvent can be varied widely, it may be chosen from any number of organic solvents or mixtures which are commercially available and economically feasible to use in this process.

When the elastomer is used as a suspension, the solids may constitute any percent of the total suspension. The preferred range is about 0.25 percent to about 80 percent solids. This range of about 0.25 percent to about 80 percent is also preferred when the elastomer is used in a solution. The final film or coating will withstand a 6-foot head of water for one minute but the ammonia or amine vapor or amine transmission rate of the film or coating is sufficient to develop a silver halide emulsion in 1 minute at about 60° C.

The fluid activator may be either gaseous or liquid. If gaseous, it is used with a binder for the light-sensitive material which it penetrates but does not dissolve or make tacky.

In the same manner, the liquid activator may be used alone or mixed with one or more solvents depending upon the particular binder used to obtain a dry processed element. Any convenient ratio of solvents can be used providing sufficient alkaline material penetrates the outermost layers of the exposed element to form an image in the silver halide layer having a density ($D_{max}$) of at least 0.5 in 5 minutes at 20° C.

In the event a fluid activator is used with a binder which is hydrophobic but permits penetration of an amine or ammonia, gaseous activation can be used. If a liquid activator is desired, a liquid amine can be used or an aqueous solution containing an amine or other alkaline material. In the event an aqueous solution is employed, the preferred weight ratio of amine or alkaline material can be from 10 to 100 percent.

Many different types of amines can be employed in the process of this invention. Typical examples of these amines are imidazole, alkyl-substituted imidazoles, pyridine, amino-substituted pyridines, guanidines, alkylamines, alkanolamines, alkylenediamines, alkoxyamines, and the like. Particularly preferred for use in the process of this invention because of their freedom from objectionable odors and excellent performance in developing the image are amines of the formula:

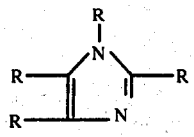

wherein each R is independently a hydrogen atom or an alkyl group of 1 to 6 carbon atoms. Examples of amines represented by this formula are imidazole, 1-methylimidazole, 2-methylimidazole, 2-ethylimidazole, 2-butylimidazole, 2-hexylimidazole, 1,2-dimethylimidaxole, 2-ethyl-4-methylimidazole, and the like.

The temperature at which processing can occur according to the invention depends upon the element, binder, activator, etc., but typical temperatures are from 20° to 80° C, preferably from 20 to 40° C.

The following examples are included for a further understanding for the invention:

EXAMPLE 1 — Preparation of a Silver Chloride Emulsion In Cellulose Propionate

Five grams of cellulose propionate, approximately 36 percent propionyl, are dissolved in 25 ml methanol and 25 ml dichloromethane. Potassium chloride, in the amount of 0.37 gram, is dissolved in 3.3 ml water and 6.7 ml methanol and is added to the propionate solution with stirring. An amount of 0.66 gram of silver nitrate is dissolved in 1.3 ml water and 6.7 ml methanol and is added slowly to the mixture of potassium chloride and cellulose propionate. The total amount of water is less than that which causes precipitation of the propionate. It is stirred for five minutes and the emulsion is precipitated by pouring slowly into 49° C water with vigorous stirring. The shredded emulsion is collected and dried.

EXAMPLE 2 — Preparation of a Photographic Element Using the Emulsion of Example 1

The dry emulsion of Example 1, in the amount of 3.6 grams, is dissolved in 12.5 ml methanol and 12.5 ml dichloromethane. To this solution are added with stirring:

| | Amount |
|---|---|
| Ethylenedithia-αα'-dipropionic acid | 0.70 gram |
| α-(2-morpholinethylthio)-β-phenylpropiophenone | 0.70 gram |
| Guanidine trichloroacetate | 0.75 gram |
| Hydroquinone | 0.50 gram |
| 4-Methyl-1-phenyl-3-pyrazolidone | 1.00 gram |

The mixture is coated at 0.0075 inch wet thickness on a Baryta coated paper base and dried. The coating is exposed to a photographic test object and then fumed in gaseous ammonia at room temperature for 90 seconds. A moderately dense, green-brown image on an off-white background is produced. The processed print is stable to light without further treatment.

EXAMPLE 3 — Preparation of Silver Chloride Emulsion In Cellulose Propionate of Higher Propionyl Content Than Example 1

The preparation is as described in Example 1, except that the cellulose propionate has approximately 39 percent propionyl. The precipitated emulsion is washed with distilled water twice before drying.

EXAMPLE 4 — Preparation of a Photographic Element Using an Emulsion After Prolonged Storage A dry emulsion is prepared as follows:

In a 600 ml beaker, place 125 ml cellulose propionate (approximately 39 percent propionyl), 20 percent solids in methanol-dichloromethane, 1:1. Add 37 ml methanol and 37 ml dichloromethane. Add 40 ml KCl (3.73 grams in a mixture of 33 ml $H_2O$ and 67 ml methanol) with stirring. Add slowly, 32 ml silver nitrate (2.65 grams in a mixture of 5⅓ ml $H_2O$ and 26⅔ ml methanol) while stirring vigorously. Stir for 5 minutes. Pour into hot water slowly, i.e. 90° C, and separate fibers from water. Wash several times with distilled water. Dry.

The dried emulsion is stored at room temperature until used. Such an emulsion may be stored for at least 4 years. A photographic element of the invention is prepared as follows:

Six grams of the dry emulsion are dissolved in 15 ml methanol and 15 ml dichloromethane. Dissolve 1.0 grams methyl gallate and 1.45 grams β-(ethylcarbamoylthio)propanesulfonic acid, guanidine salt in 15 ml methanol and add to the dissolved emulsion. Coat the mixture at 0.0075 inches wet thickness on 4 mil polyester support and dry. The coating is exposed to a photographic test object and fumed for 45 seconds over ammonium hydroxide at room temperature. This processing produces a light-stable image which has a maximum density of 2.17 and a minimum density of 0.11. This result shows excellent shelf life for the dry emulsion.

EXAMPLE 5 — Preparation of a Silver Chlorobromide Emulsion

Six grams of cellulose propionate (39% propionyl) are dissolved in 30 ml methanol and 30 ml dichloromethane. An amount of 1.29 grams lithium bromide and 0.66 gram lithium chloride are dissolved in 15 ml methanol and then added to the propionate solution. An amount of 6.63 grams silver trifluoroacetate are dissolved in 15 ml methanol and added slowly, with stirring, to the propionate solution to form a stable dispersion. Since both the halide salts and the silver salt are soluble in methanol, there is no need to add any water to the system for solubility.

EXAMPLE 6 — Preparation of a Photographic Element Using The Emulsion of Example 5

To 2.25 grams of cellulose propionate (39% propionyl) dissolved in 7.5 ml methanol and 7.5 ml dichloromethane, add 1.0 gram methyl gallate and 0.1 gram 1-phenyl-3-pyrazolidone and 0.95 gram β-(ethylcarbamylthio) propane sulfonic acid, guanidine salt. Ten ml of the emulsion prepared in Example 5 are added to the previously prepared solution of propionate. The mixture is coated at 0.004 inch wet thickness on 4 mil polyester support and dried. After exposing the coating to a photographic test object, the coating is subjected, for 45 seconds at room temperature, to the fumes of a 40 percent methylamine solution. A photographic image of moderate density and fog is produced. The processed material is not effected by light.

EXAMPLE 7 — Preparation of a Silver Chloride Emulsion

A silver chloride emulsion is prepared in the same matter as the emulsion of Example 5 except that the 1.29 grams lithium bromide is replaced with 0.66 gram lithium chloride. A stable dispersion is formed. This is similar to Example 1, except that no water is used in the preparation.

EXAMPLE 8 — Preparation of a Photographic Element Using the Emulsion of Example 7

An amount of 2.25 grams of cellulose propionate (39% propionyl) is dissolved in 7.5 ml methanol and 7.5 ml dichloromethane. One gram methyl gallate and 1.42 grams β-(ethylcarbamoylthio) propane sulfonic acid, guanidine salt are dissolved in the propionate solution. To this solution are added 10 ml of the emulsion of Example 7. The mixture is coated at 0.004 inch wet thickness on 4 mil polyester support and dried. After exposure to a photographic test object, the coating is fumed with ammonia fumes for 45 seconds at room temperature. An image with a maximum density of 1.25 and a minimum density of 0.07 is produced. This image was stable to light.

EXAMPLE 9 — Aqueous Processing of the Photographic Element of Example 8

A section of the photographic element prepared in Example 8 is exposed to a photographic test object. Processing is accomplished by immersing the element in a 4 percent solution of ammonium hydroxide for 10 seconds at room temperature. A light-stable record of the test object is obtained having a maximum density of 1.04 and a minimum density of 0.09. While the processing solution is aqueous, the liquid portion of the solution appears not to penetrate the coated layer and emerges free from tack and "dry to the touch" from the solution.

EXAMPLE 10 — Illustration of a Variety of Effective Activators

An element as described in Example 6 is prepared. It is coated on polyester film base at a level of 12 mg of silver per square decimeter.

This element is exposed to light, immersed for 10 seconds in 10 percent aqueous solutions of various amines and alkalies at 60° C and withdrawn. The draining pattern is observed: if the solution drains freely and rapidly leaving a completely dry surface, it is termed "Good"; if it drains more slowly, or leaves some pattern, the draining is termed "Fair"; if it wets the surface and leaves appreciable residue, the draining is termed "Poor". Similarly, image development is observed—a density of about 1.0 is considered Good, higher densities "Very good", densities between 0.1 and 0.5, "Low", and densities between 0.5 and 1.0 as Fair.

The results obtained with a variety of amines are listed in Table I.

Although they differed in degree of effectiveness, it will be observed that alkali hydroxides and a variety of amines, diamines and other polyamines, heterocyclic amines, alkanol amines, and alkoxy amines penetrate the barrier layer to cause image development and yet drain well from the layer. Certain amines are insufficiently soluble in water to be tested in this system (e.g., phenylethylamine, pentylamine, triethylamine, aniline, and pyrrole). Very weakly alkaline amines; such as, imidazole developed only weakly, and certain other amines (e.g., diethanolamine) penetrate this barrier layer too slowly to be effective in this test but produce images when processing time is prolonged. A few amines, e.g., pyrrolidine, wet this cellulose acetate barrier layer. The preferred amine or alkali is adapted to the barrier layer.

TABLE I

| Alkali | Development | Draining |
|---|---|---|
| Ammonium hydroxide | Good | Good |
| Methylamine | Very good | Good |
| Isopropylamine | Very good | Good |
| n-Butylamine | Very good | Good |
| t-Butylamine | Very good | Good |
| Benzylamine | Very good | Good |
| Ethylene diamine | Very good | Good |
| 1-Aminoethanol | Fair | Good |

TABLE I-continued

| Alkali | Development | Draining |
|---|---|---|
| 2-Aminoethanol | Fair | Good |
| 1-Amino-2-propanol | Fair | Good |
| 2-Amino-2-methyl-1-propanol | Fair | Good |
| N,N-Diethylamine | Good | Good |
| N-Methyl-N-butylamine | Good | Fair |
| N-Bis-hydroxyethyl-N-ethylamine | Weak | Good |
| N-Hydroxypropyl-N-diethylamine | Fair | Good |
| Piperazine | Good | Good |
| 2-Methylpiperazine | Very good | Fair |
| N-Methylimidazole | Good | Good |
| 2-Ethyl-4-methylimidazole | Good | Good |
| 2-Aminopyridine | Fair | Good |
| Hexamethyleneimine | Very good | Good |
| Propane-1,2-diamine | Very good | Good |
| Propane-1,3-diamine | Very good | Good |
| Hexane-1,6-diamine | Very good | Good |
| N,N-Diethylethylene diamine | Very good | Good |
| N,N-Dimethyl-1,3-propane diamine | Very good | Good |
| N,N-Diethyl-1,3-propane diamine | Very good | Good |
| 1,4-Cyclohexanebis(methylamine) | Very good | Good |
| Diethylene triamine | Good | Good |
| Triethylene tetramine | Fair | Good |
| 3,3'-Diaminodipropylamine | Very good | Good |
| N,N-Bis(2-Aminoethyl)-1,3-propanediamine | Good | Good |
| Cyclohexylamine | Very good | Good |
| 2-Methoxyethylamine | Very good | Fair |
| 3-Methoxypropylamine | Very good | Good |
| 4-Aminomethylpiperidine | Very good | Good |
| Guanidine | Fair | Good |
| Potassium hydroxide | Good | Fair |
| Lithium hydroxide | Very good | Fair |

EXAMPLE 11 — Illustration of Concentration Effects

The element of Example 10 is exposed to light behind a step wedge and is then processed by immersion in aqueous solutions of ethanolamine for the times and temperatures indicated in Table II. The higher concentrations of ethanolamine offer advantages in improved density and decreased fog and stain. In each case, excess solution is squeeged from the surface to produce dry, hard film which can be handled freely or rolled on itself. The images are transparent, stable and unaffected by prolonged exposure to daylight.

EXAMPLE 12 — Non-Aqueous Solvent

An element of Example 10 is exposed to light and processed by immersion in a solution containing 12 parts of isopropyl amine, and 90 parts hexane by volume. After immersion of 60 seconds at 20° C, a dense image is produced and the film is withdrawn. The solution drains freely to leave a hard dry film. Improvement in rate is obtained by adding small quantities of ethylene glycol or of water.

TABLE II

| Ethanolamine Percent | Time (Sec) | Temp (° C) | Image Gamma | Image Density | Fog (Gross) | Stain (to blue light) |
|---|---|---|---|---|---|---|
| 10 | 30 | 45 | 0.80 | 1.56 | 0.28 | 0.17 |
| 40 | 30 | 45 | 1.17 | 2.24 | 0.28 | 0.11 |
| 50 | 40 | 40 | 1.37 | 2.36 | 0.18 | 0.03 |

Table III

| Hexamethylene-imine | 2-Methyl imidazole | Max Density | Emulsion Speed | Stain |
|---|---|---|---|---|
| 20% | 0% | 1.98 | Normal | Medium |
| 20% | 10% | 1.93 | −0.3 Log E | Low |
| 20% | 20% | 2.19 | −0.45 Log E | Very Low |

EXAMPLE 13 — Alternative Barrier Layer

The cellulose proprionate of Example 6 is replaced with cellulose acetate butyrate, 17 percent butyryl. The coating is also modified by the inclusion of 10 percent triphenyl phosphate as a plasticizer. The coating level is approximately that of Example 2, about 12 mg per square decimeter. The film is exposed to light behind a step wedge and immersed in a 50 percent solution of ethanolamine at 60° C for 12 seconds. On withdrawal, the solution drains from the silver halide layer to leave a firm surface. The image has high density (2.15) and contrast ($\gamma - 2.3$) and is stable toward further exposure to light.

EXAMPLE 14 — Mixture of Amines

The element of Example 6 contains both developing agents and a stabilizer precursor ($\beta$-(ethyl-carbamyl-thio)propane sulfonic acid, guanidine salt). The stabilizer precursor may be freed by nuclear addition of even a weakly alkaline amine (e.g., 2-methylimidazole) whereas a more alkaline amine (e.g., hexamethyleneimine) is required to activate the developing agents. It is advantageous in some applications to use a mixture of amines to obtain a desired competitive effect between the developing and fixing reactions. The element of Example 6 is exposed to light and processed in the mixture of amines, as indicated in Table III, for 5 seconds at 49° C. The results obtained are indicated in Table III. The addition of methyl imidazole causes some loss in emulsion speed but produces higher maximum density and lower stain.

EXAMPLE 15 — Freedom from Tackiness

Two items are employed, namely: (1) an element as described in Example 6; (2) an element as described in Example 13. Each strip (35 mm wide) is immersed in a 50-50 by weight water-ethanolamine solution for 15 seconds at 57° C, withdrawn through squeegees, and pressed by rollers under 15 lb. pressure into contact with an unprocessed piece of the same film. After contact times of either (a) 20 seconds or (b) 50 minutes, they are stripped apart, using a spring gauge to measure the force needed for stripping. The results are entered in Table IV. The effectiveness of the hydrophobic vehicles in reducing tack is clearly shown.

TABLE IV

| Vehicle | Adhesion-20 sec. | After 50 min. |
|---|---|---|
| Cellulose Acetate Propionate | 0 oz. | 0 oz. |
| Cellulose Acetate Butyrate | ~⅛ oz. | ~⅛ oz. |

EXAMPLE 16 — Contact Angle of Vehicle

Sections of film as described in Examples 6 and 13 are prepared. A drop of water placed on the surface of each section shows a contact angle of about 90°. Activation of the photographic layers in gaseous methylamine produces dense black images on a clear background, the surface of which is substantially free of tack.

Photographic silver halide emulsions, preparations, addenda, processing and systems may be used as disclosed in paragraphs I through XVIII and XXIII in *Product Licensing Index*, December 1971.

The invention has been described with particular reference to preferred embodiments therein but it will be understood that variations and modifications can be effected within the spirit and scope of the invention.

We claim:

1. A radiation-sensitive element in which silver halide is the sole source of image-forming silver comprising a water-impermeable support having thereon a radiation-sensitive silver halide layer containing a silver halide developing agent in a binder which is a water-impermeable cellulose ester of a lower aliphatic carboxylic acid having two to four carbon atoms, said binder being permeable to ammonia or amine.

2. An element of claim 1 in which said developing agent comprises methyl gallate.

3. An element of claim 1 in which said developing agent comprises 1-phenyl-3-pyrazolidone.

4. An element of claim 1 in which said developing agent comprises ascorbic acid.

5. An element of claim 1 in which said developing agent comprises a 4,5,6-trihydroxy pyrimidine.

6. An element of claim 1 also comprising a stabilizer precursor.

7. An element of claim 6 in which said stabilizer precursor comprises 3-S-thiuronium 1-methyl-propane sulfonate.

8. An element of claim 6 in which said stabilizer precursor comprises a 3(ethylcarbamoylthio) propane sulfonic acid salt.

9. An element of claim 1 in which said binder comprises cellulose propionate.

10. An element of claim 1 in which said binder comprises cellulose acetate.

11. An element of claim 1 in which said binder compriss cellulose acetate butyrate.

12. A process for obtaining an image in a radiation sensitive-element in which silver halide is the sole source of image forming silver comprising the steps of a. imagewise exposing said element;

b. activating said element by contacting said element with an alkaline fluid activator comprising an amine or ammonia, said element comprising a support substantially impermeable to said fluid, said support having thereon a radiation sensitive silver halide layer containing a silver halide developing agent in a binder which is a water-impermeable cellulose ester of a lower aliphatic carboxylic acid having 2 to 4 carbon atoms said binder being permeable to an amine or ammonia.

13. The process of claim 12 wherein the surface of said element is substantially free from tack after contacting with said fluid.

14. A process of claim 12 comprising contacting said element with a solution comprising an alkaline material comprising an amine or ammonia.

15. A process of claim 14 in which said element also contains a stabilizer precursor capable of activation in an alkaline material comprising an amine or ammonia.

16. A process of claim 12 wherein said alkaline fluid activator comprises a liquid containing an alkaline material which is an amine or ammonia and said element comprises a hydrophobic binder permeable to said alkaline material.

17. A process of claim 16 in which said element contains a stabilizer precursor capable of activation in an alkaline material comprising an amine or ammonia.

18. A process of claim 17 in which:

a. said radiation-sensitive silver halide layer is contained in a hydrophobic binder.

b. said developing agent is contained in a hydrophobic binder, c. said element is maintained in contact with said fluid for a time sufficient to develop a silver image but insufficient to render said element tacky, and d. said developed element is removed from contact with said fluid after the time described in (c) above.

19. A process of claim 18 in which said fluid is an alkaline solution.

20. A process of claim 18 in which said fluid is ammonia or amine vapor.

21. A process of claim 13 in which said element also comprises at least one layer containing a stabilizer precursor.

22. A process of claim 12 in which said element comprises a polyester support having thereon silver halide and a developing agent incorporated in a cellulose propionate binder comprising immersing said element in an aqueous solution containing ethanolamine.

23. A radiation-sensitive element in which silver halide is the sole source of image-forming silver comprising a water impermeable support having thereon a radiation-sensitive silver halide layer containing a silver halide developing agent selected from the class consisting of hydroquinone, methyl gallate, 1-phenyl-3-pyrazolidone, ascorbic acid and 4,5,6-trihydroxy pyrimidine and a stabilizer precursor selected from the class consisting of 3-S-thiuronium 1-methyl-propane sulfonate and 3(ethylcarbamoylthio) propane sulfonic acid salt in a water-impermeable cellulosic binder selected from the class consisting of cellulose propionate, cellulose acetate, cellulose acetate butyrate and ethyl cellulose, said binder being permeable to ammonia or an amine.

24. A radiation-sensitive element in which silver halide is the sole source of image-forming silver comprising a water-impermeable support having thereon a radiation-sensitive silver halide layer containing a hydroquinone silver halide developing agent and a thiuronium stabilizer precursor in a water-impermeable cellulose propionate binder permeable to ammonia or an amine.

* * * * *